US009548827B2

(12) United States Patent
Jones

(10) Patent No.: US 9,548,827 B2
(45) Date of Patent: Jan. 17, 2017

(54) SYSTEM AND METHOD FOR PROVIDING EMERGENCY ALERT MESSAGE BROADCAST INTERRUPTION IN A VEHICLE

(71) Applicant: Honda Motor Co., Ltd., Tokyo (JP)

(72) Inventor: Bruce McCulloch Jones, Half Moon Bay, CA (US)

(73) Assignee: Honda Motor Co., Ltd., Tokyo (JP)

( * ) Notice: Subject to any disclaimer, the term of this patent is extended or adjusted under 35 U.S.C. 154(b) by 314 days.

(21) Appl. No.: 14/197,270

(22) Filed: Mar. 5, 2014

(65) Prior Publication Data

US 2015/0256276 A1 Sep. 10, 2015

(51) Int. Cl.

| | |
|---|---|
| ***H04H 20/71*** | (2008.01) |
| ***H04H 20/59*** | (2008.01) |
| ***H04H 20/62*** | (2008.01) |
| ***H04H 20/10*** | (2008.01) |
| ***H04H 20/40*** | (2008.01) |
| ***H04H 60/27*** | (2008.01) |
| ***H04H 60/37*** | (2008.01) |
| ***H04H 60/51*** | (2008.01) |
| ***H04H 60/65*** | (2008.01) |

(52) U.S. Cl.

CPC ..... *H04H 20/59* (2013.01); *H04H 20/106* (2013.01); *H04H 20/40* (2013.01); *H04H 20/62* (2013.01); *H04H 60/27* (2013.01); *H04H 60/37* (2013.01); *H04H 60/51* (2013.01); *H04H 60/65* (2013.01)

(58) Field of Classification Search

USPC ..... 455/3.01

See application file for complete search history.

(56) References Cited

U.S. PATENT DOCUMENTS

| | | | | |
|---|---|---|---|---|
| 5,574,999 | A | 11/1996 | Gropper | |
| 2005/0008325 | A1* | 1/2005 | Ollis | H04H 60/16 386/296 |
| 2007/0037549 | A1* | 2/2007 | Poltorak | G08B 27/008 455/404.1 |
| 2010/0105315 | A1 | 4/2010 | Albrett | |
| 2013/0210340 | A1 | 8/2013 | Pharn | |

FOREIGN PATENT DOCUMENTS

| | | |
|---|---|---|
| WO | 0145386 | 6/2001 |

* cited by examiner

*Primary Examiner* — Ankur Jain

(74) *Attorney, Agent, or Firm* — Rankin, Hill & Clark LLP

(57) ABSTRACT

A system and method for providing emergency broadcast interruption is provided for a vehicle. The system and method include monitoring one or more radio broadcast transmissions, detecting for emergency alert messages on the one or more radio broadcast transmissions, recording the one or more emergency alert messages from the one or more radio broadcast transmissions in which the one or more emergency alert messages are detected, and enabling immediate playing of the one or more emergency alert messages.

20 Claims, 5 Drawing Sheets

| ER. ALERT DESCRIPTION - ER. ALERT TYPE | ER. ALERT MESSAGE PRIORITIZATION |
|---|---|
| DEMONSTRATION TEST - MESSAGE | VERY LOW |
| EARTHQUAKE - WARNING | HIGH |
| FLASH FLOOD - WATCH | MEDIUM |
| FLASH FLOOD - WARNING | HIGH |
| HURRICANE WATCH | HIGH |
| HURRICANE WARNING | SEVERE |
| HIGH WIND WATCH | LOW |
| HIGH WIND WARNING | MEDIUM |
| SEVERE THUNDERSTORM WATCH | MEDIUM |
| SEVERE THUNDERSTORM WARNING | HIGH |
| TORNADO WATCH | HIGH |
| TORNADO WARNING | SEVERE |
| TSUNAMI WATCH | HIGH |
| TSUNAMI WARNING | SEVERE |
| WINTER STORM WATCH | LOW |
| WINTER STORM WARNING | MEDIUM |

FIG. 3

SYSTEM AND METHOD FOR PROVIDING EMERGENCY ALERT MESSAGE BROADCAST INTERRUPTION IN A VEHICLE

BACKGROUND

Vehicle manufacturers are increasingly designing safety features within vehicles with the intent of increasing the safety of passengers. Many of these systems include safety warning features that are designed to warn the driver of driving related risks. In some instances, these safety measures take into account environmental conditions such as inclement weather that influence sensors that are attached to the vehicle to alert the driver for issues that can affect the safety during vehicle operation. However, these systems often are unable to warn of possible or arising emergencies that take place in the broader environment that can affect the safety of occupants in the vehicle.

In the United States, the Emergency Alert System (EAS) (formally the Emergency Broadcast System) is designed to communicate civil emergency messages and warnings that can affect people that are located in a certain location (i.e., nationally, statewide or local). The EAS requires television and radio broadcasters (including terrestrial and satellite radio service providers) to broadcast emergency alert messages related to national, state, and local emergencies. In many instances, the emergency alert messages contain important emergency information provided by many national, state, and/or local agencies to promote and ensure the safety of those in viewing or listening range of the broadcasts.

In many instances, the emergency alert messages can be very impactful in ensuring that those in the viewing or listening range of the EAS broadcast are properly warned and can take adequate measures to protect themselves against a potential or impending emergency. In many instances, the measures that can be taken by a driver and/or passengers in adequately reacting to the emergency alert message can translate into life saving measures. For example, an emergency alert message may contain a tornado warning which can alert the driver of the vehicle to steer away from a certain area.

There are some shortfalls with the EAS system that can affect the vehicle occupants from receiving emergency alert message broadcasts. One key shortfall of the current EAS system is that if the vehicle is not in operation (i.e., turned OFF), the vehicle occupants can not receive the emergency alert message if they are not listening or viewing a broadcast containing the emergency alert message outside of the vehicle. Another shortfall of the current EAS system lies in the fact that the listener (i.e., driver and/or passenger) must be utilizing the radio function of the audio system of the vehicle and the radio must be tuned in to the radio station channel (i.e., frequency) that is broadcasting the emergency alert message. In addition, the likelihood of vehicle occupants missing the broadcast of an emergency alert message is highly increased in modern vehicles that include many other infotainment options and features (other then radio) that are utilized by the vehicle occupants.

SUMMARY

According to one aspect, a method for providing emergency broadcast interruption is provided for a vehicle. The method includes monitoring one or more radio broadcast transmissions. The method further includes detecting for emergency alerts on the one or more radio broadcast transmissions and recording the one or more emergency alerts from the one or more radio broadcast transmissions in which the emergency alerts are detected. The method also includes enabling immediate playing of the one or more emergency alerts.

According to a further aspect, a system for providing emergency broadcast interruption in a vehicle is provided. Specifically, in accordance with this aspect, the system includes an emergency alert monitoring module for monitoring one or more radio broadcast transmissions received by one or more radio receivers. The system also includes an emergency alert detection module for detecting one or more emergency alert messages on the one or more radio broadcast transmissions received by one or more radio receivers. Additionally, the system includes a recording module for enabling the recording, on a storage device of a digital audio recorder, the one or more emergency alert messages from the one or more radio broadcast transmissions received by one or more radio receivers in which the emergency alerts are detected. The system further includes an emergency alert controller module for enabling an emergency alert message interruption system to immediately play the one or more emergency alerts from the one or more radio broadcasts received in which the emergency alerts are detected.

According to still another aspect, a computer readable medium comprising instructions that when executed by a processor to execute a method for providing emergency broadcast interruption is provided for a vehicle. The method includes monitoring one or more radio broadcast transmissions and monitoring one or more radio broadcast transmissions. The method further includes detecting for emergency alerts on the one or more radio broadcast transmissions and recording the one or more emergency alerts from the one or more radio broadcast transmissions in which the emergency alerts are detected. The method also includes enabling immediate playing of the one or more emergency alerts.

BRIEF DESCRIPTION OF THE DRAWINGS

FIG. 3 is an illustrative example of an exemplary simple prioritization list that can be utilized by the emergency alert prioritization module of FIG. 2 to categorize emergency alert messages according to an embodiment of the disclosure;

DETAILED DESCRIPTION

The following includes definitions of selected terms employed herein. The definitions include various examples and/or forms of components that fall within the scope of a term and that can be used for implementation. The examples are not intended to be limiting.

A "processor," and a "control unit," as used herein, processes signals and performs general computing and arithmetic functions. Signals processed by the processor and/or control unit can include digital signals, data signals, computer instructions, processor instructions, messages, a bit, a bit stream, or other means that can be received, transmitted and/or detected.

An "interface circuit" as used herein, refers to is a circuit that links one type of device or component such as the processor with another device or component and converts voltages between the processor and a receiving device or component.

An "operable connection," as used herein can include a connection by which entities are "operably connected", is one in which signals, physical communications, and/or logical communications can be sent and/or received. An operable connection can include a physical interface, a data interface and/or an electrical interface.

A "computer communication," as used herein, refers to a communication between two or more computing devices (e.g., computer, personal digital assistant, cellular telephone, network device) and can be, for example, a network transfer, a file transfer, an applet transfer, an email, a hypertext transfer protocol (HTTP) transfer, and so on. Computer communication can occur using various protocols and technologies as is known in the art. For example, these can include a wireless system (e.g., IEEE 802.11, IEEE 802.15.1 (Bluetooth)), an Ethernet system (e.g., IEEE 802.3), a token ring system (e.g., IEEE 802.5), a near field communication system (NFC) (e.g., ISO 13157), a local area network (LAN), a wide area network (WAN), a point-to-point system, a circuit switching system, a packet switching system, a cellular network system (e.g., CDMA, GSM, LTE, 3G, 4G), a universal serial bus, among others.

A "storage device" as used herein, includes volatile memory and/or nonvolatile memory. Non-volatile memory can include, for example, ROM (read only memory), PROM (programmable read only memory), EPROM (erasable PROM) and EEPROM (electrically erasable PROM). Volatile memory can include, for example, RAM (random access memory), synchronous RAM (SRAM), dynamic RAM (DRAM), synchronous DRAM (SDRAM), double data rate SDRAM (DDR SDRAM), and direct RAM bus RAM (DRRAM).

A "user interface," as used herein can include is a program that uses graphical controls which a user can select by various types of mechanisms such as software and hardware based controls, interfaces, or plug and play devices.

Figure 1:
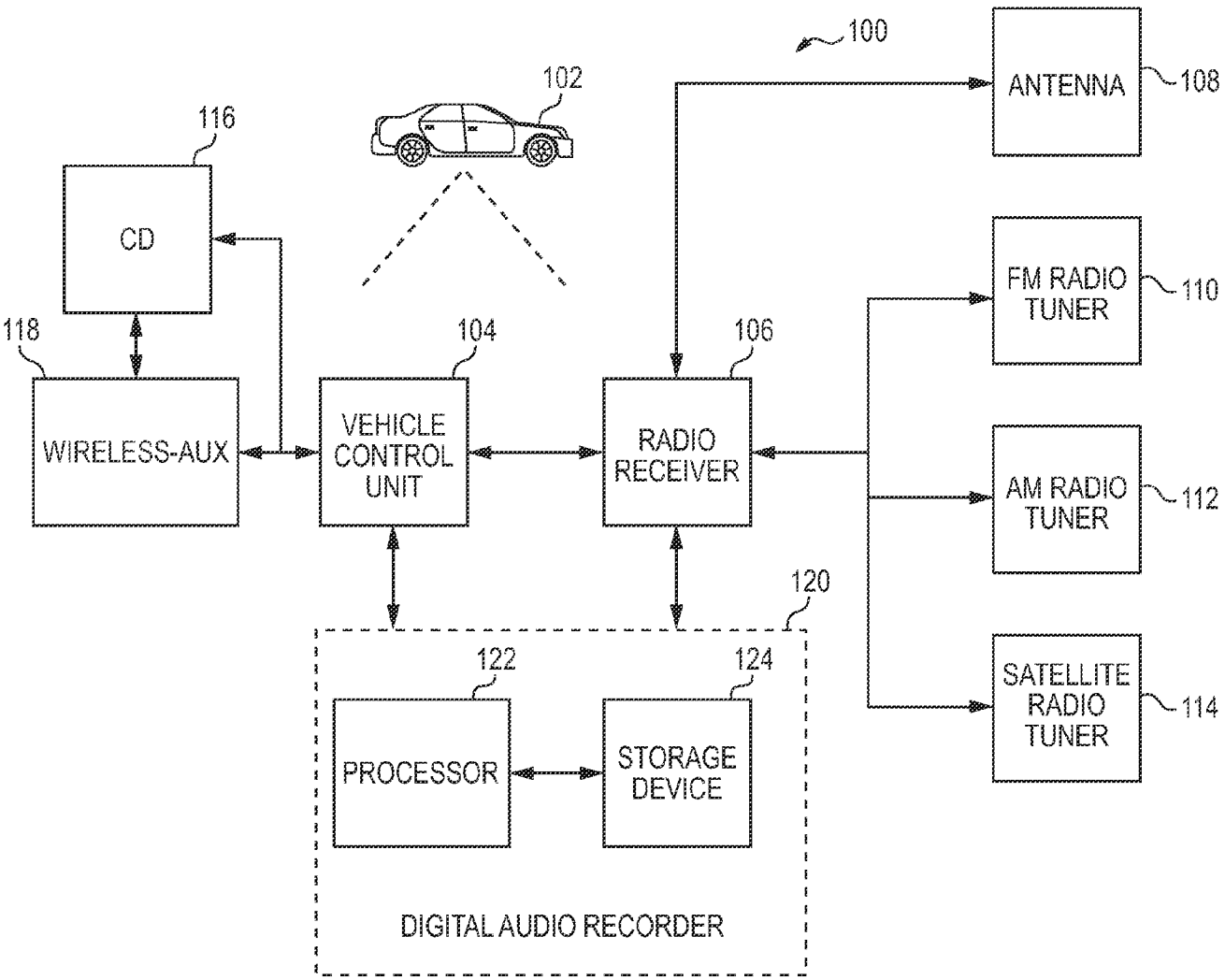
FIG. 1 is a schematic view of an exemplary vehicle audio system according to an embodiment of the disclosure.

Referring now to the drawings, wherein the showings are for purposes of illustrating one or more exemplary embodiments and not for purposes of limiting the same, FIG. 1 shows a schematic view of a vehicle audio system 100 as an electronic instrument which can be part of an overall infotainment system (not shown) on vehicle 102. The audio system 100 can be utilized in a head unit (not shown) of the vehicle 102. The audio system 100 and its components can be operably connected to a vehicle control unit (VCU) 104. The audio system 100 includes a radio receiver 106, an antenna 108, a FM radio tuner 110, an AM radio tuner 112, a satellite radio tuner 114, a CD player 116, and a wireless-auxiliary player 118.

The audio system 100 component hardware installed within the head unit of the vehicle 102 can be incorporated with or into other non-audio vehicle subsystems which provide a unified hardware form factor for various components of the audio system 100. The VCU 104 can control various functions and components of the vehicle 102, including but not limited to the audio system 100 and the broader infotainment system. In some embodiments, the audio system 100 and/or the infotainment system may include a separate processor (not shown) that independently controls the operations of the audio system 100 and/or infotainment system components.

In the embodiment shown in FIG. 1, the audio system 100 can be initialized when a vehicle 102 occupant (i.e., user, not shown) utilizes an ON button or switch and when an accessory (ACC) power or the power of the vehicle 102 is turned ON. The VCU 104 controls an overall operation of the audio system 100. The VCU 104 includes internal processing memory, an interface circuit, and bus lines as described in detail above, for transferring data, sending commands, and communicating to various components of the audio system 100.

The VCU 104 is also operatively connected to at least one radio receiver 106 that receives radio frequencies and/or satellite radio signals from one or more antenna(s) 108 that intercept AM/FM radio frequency waves and/or satellite radio signals. The radio receiver 106 converts frequency waves/signal data from the antenna(s) 108 into usable radio channel data which can be in the form of AM radio station channels, FM radio station channels, and/or satellite radio station channels. In an alternate embodiment, the antenna(s) 108 can also intercept television frequency waves and/or satellite television signals and can be operatively connected to a television receiver (not shown). The antenna(s) can send television frequencies and/or satellite television signals to the television receiver to be utilized by the infotainment video system of the vehicle 102.

In an exemplary embodiment, the radio receiver 108 is operatively connected to the FM radio tuner 110, the AM radio tuner 112, and the satellite radio tuner 114. The tuners 110-114 are utilized by the radio receiver 106 to tune in radio station channels, as described in more detail below. The VCU 104 is also operatively connected to additional audio system players that can include but are not limited to the CD player 116 and the wireless-auxiliary input player 118.

The audio system 100 can include a communication device (not shown) that is capable of conducting wired or wireless computer communication. The wireless-auxiliary input player 118 can be utilized for playing audio through a wireless format (e.g., Bluetooth) via the communication device or a wired connection through an auxiliary port located within the vehicle 102. In one embodiment, the audio system 100 may include graphical user interface inputs on an audio system user interface (not shown) or an infotainment system user interface (not shown) that presents a user with a plurality of audio mode icons which correspond to initialize respective audio players or the radio such as described above.

In the embodiment shown in FIG. 1, the audio system 100 includes a digital audio recorder 120 that is operably connected to the VCU 104. The digital audio recorder 120 can be a stand alone unit that can be attached and/or detached with the audio system 100 of the vehicle 102. In an exemplary embodiment, the digital audio recorder 120 is operably connected to the radio receiver 106 of the audio system 100. The digital audio recorder 120 includes a processor 122 and a storage device 124 that can be utilized to record audio that consists of one or more terrestrial (e.g., AM or FM) or satellite radio broadcasts that are provided by the tuners 110-114 to the radio receiver 106. The digital audio recorder 120 can be utilized to playback audio that was streamed from the radio receiver 106 and digitally stored within the storage device 124. The processor 122 controls and operates the various functions of the of the digital audio recorder 120 including but not limited to the functions of record, playback, delete, rewind, pause, and fast forward.

In addition to recording content provided by the radio receiver 106, in some embodiments the digital audio recorder 120 can be utilized to record content from other components of the audio system such as the CD player 116 and/or the wireless-auxiliary input player 118. In one embodiment, the digital audio recorder 120 can also be utilized to record content that is being provided by the broader infotainment system. For example, the digital audio recorder 120 can be utilized to record audio content that is streamed through a vehicle Wi-Fi entertainment system.

In one embodiment, the VCU 104 may initialize the digital audio recorder 120 to commence recording or playback stored audio. Audio recording and playback can be initialized by user actuation to start the recording of audio that is being provided by the radio receiver 106. The user actuation of recording and/or playback can take place on physical controls (i.e., buttons) provided on the head unit of the audio system 100. Alternatively, the user actuation can take place on the audio system user interface or the infotainment system user interface (not shown) that presents a user with a plurality of icons that correspond to initialize the controls associated with the digital audio recorder 120. For example, the audio system 100 user interface or infotainment system user interface can include graphical user interface inputs to record, rewind, fast-forward, delete, and/or playback audio content through the digital audio recorder 120. Once the user actuates a function of the digital audio recorder 120 via the audio system 100 and/or infotainment system controls, the VCU 104 communicates with the processor 122 to initiate one or more corresponding commands with respect to the functionality of the digital audio recorder 120.

In an alternate embodiment, the processor 122 of the digital audio recorder 120 can be configured to independently control the storage device 124 to record and/or playback stored audio based off of direct user actuation of the digital audio recorder 120 itself (without any input from the audio system 100). The digital audio recorder 120 can include an independent set of user interface inputs/controls that can be utilized to actuate functions directly through the digital audio recorder 120. For example, the digital audio recorder 120 can include a separate unit that can be placed within the head unit of the vehicle 102 or in another location within the vehicle 102 that can include physical buttons or its own user interface with inputs associated to functions of the digital audio recorder 120.

In an additional embodiment, either or both the VCU 104 and/or the processor 122 of the digital audio recorder 120 can automatically initialize the digital audio recorder based on specific criteria. The specific criteria that recording is based off of may include, radio stations frequencies, genres, user preset and/or specific broadcast content that is evaluated by the systems that are utilizing the VCU 104 and/or the processor 122 of the digital audio recorder 120. In the embodiment shown in FIG. 1, the radio receiver 106 can receive multiple radio broadcasts of multiple radio station channels from the radio tuners 110-114. The digital audio recorder 120 can be capable of recording multiple radio broadcasts simultaneously on the storage device 124. The digital audio recorder 120 can also record the multiple broadcasts in the background even if the user is utilizing the audio system 100 to listen to other radio station channels (that are not being recorded) from the radio receiver 106. Additionally, the digital audio recorder 120 can also record the multiple broadcasts in the background even if the user is utilizing other components of the audio system 100 (such as the CD player 116 or the wireless-auxiliary input player 118) and/or other features of the infotainment system.

In an alternate embodiment, the digital audio recorder 120 can be utilized to continuously record broadcast radio that is streamed through the radio receiver 106 regardless of user or automatic actuation. The digital audio recorder 120 can be initialized to record radio broadcasts even if the audio system 100 and/or the radio receiver 106 is not being utilized by the user within the vehicle 102. In some embodiments, the digital audio recorder 120 is connected to the vehicle battery and can be actuated to start recording radio broadcasts upon the start of vehicle 102 battery power. For example, the radio receiver 106 can be initialized to start converting frequency/signal data and the digital audio recorder 120 can be initialized to start the recording of the streaming audio received by the radio receiver 106 upon an ACC ON ignition state, or an ON ignition state of the vehicle 102.

In some embodiments, the radio receiver 106 and/or the digital audio recorder 120 is attached to an independent power source (not shown) (i.e., internal or externally connected battery). The independent power source may be charged/recharged by the vehicle 102 alternator or an external electrical connection. The independent power source can be utilized to separately power the VCU 104, the audio system 100, the infotainment system, and/or the digital audio recorder 120 regardless of the operating state of the vehicle 102. For example, the independent power source can enable the radio receiver 106 to constantly convert frequency/signal data from the tuners 110-114 and the digital audio recorder 120 to constantly record the streaming audio received by the radio receiver 106 even if the vehicle 102 is in an OFF ignition state. In other words, the recording of radio broadcasts can constantly occur (as long as the independent power source has charging power) even if the vehicle 102 is in an OFF operating state.

In some embodiments, the VCU 104 can enable the selective powering of the radio receiver 106 and/or the digital audio recorder 120 by either and/or both of the vehicle battery and/or the independent power source. For example, the radio receiver 106 and/or the digital audio recorder 120 can receive power by the vehicle battery until a charging power is low where upon the radio receiver 106 and/or the digital audio recorder 120 can receive power by the independent power source. The selective utilization of the vehicle battery and the independent power source can ensure that the digital audio recorder 120 can constantly record (as long as both the vehicle battery and the independent power source having charging power) the streamed audio received by the radio receiver 106 when the vehicle 102 is in an OFF operating state.

Figure 2:
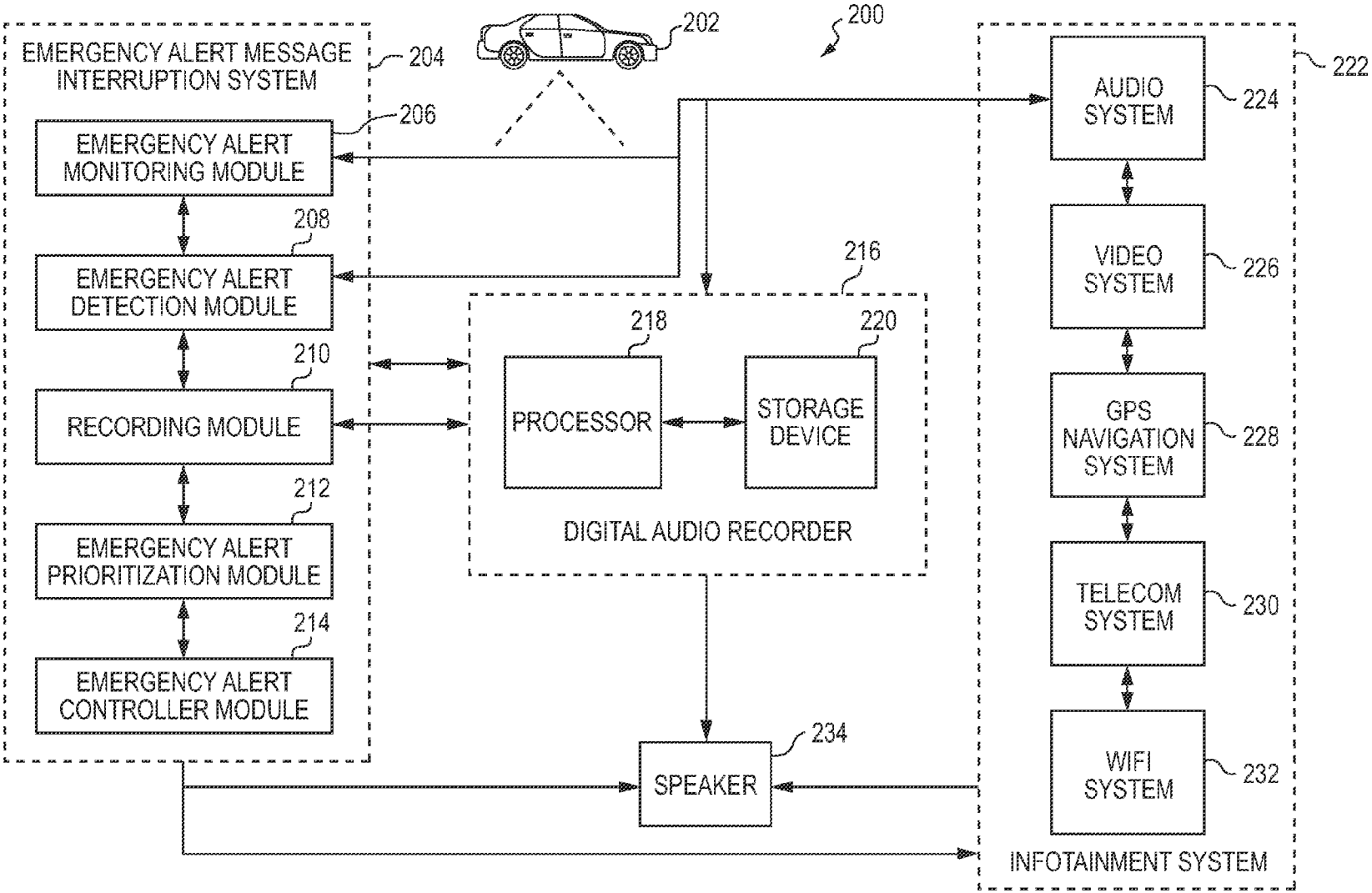
FIG. 2 is a schematic view of an exemplary vehicle safety alert system, and associated components according to an embodiment of the disclosure.

Referring now to FIG. 2, a schematic view of a vehicle safety alert system 200 is shown. The vehicle safety alert system 200 includes the emergency alert message interruption system 204. The vehicle safety alert system 200 also includes the digital audio recorder 216, the infotainment system 222, and associated components of each. The vehicle safety alert system 200 can be connected to the vehicle battery and the independent power source to ensure prolonged operation during the OFF vehicle 202 operating state.

In the embodiment shown in FIG. 2, the emergency alert message interruption system 204 is shown as a stand alone unit that is controlled by the VCU (not shown) that executes processes associated with several modules 206-214. In an alternate embodiment, the emergency alert message interruption system 204 can include a separate processor that can communicate with the VCU and that that can separately execute processes associated with the modules 206-214. In some embodiments, the emergency alert message interruption system 204 can be integrated within other vehicle 202 safety systems and/or subsystems. For example, the emergency alert message interruption system 204 can be integrated within various systems such as a driver sleep alert system, a lane assist/blind spot monitoring alert system, or a vehicle parking assist system. In alternate embodiments, the emergency alert message interruption system 204 can be included within the digital audio recorder 216 and the processor 218 can be utilized to execute the modules 206-214.

In the embodiment, shown in FIG. 2, the emergency alert message interruption system 204 is operably connected to the digital audio recorder 216, and the infotainment system 222. The emergency alert message interruption system 204, digital audio recorder 216, and infotainment system 222 can all be connected to the vehicle battery and the independent power source to ensure continuous or prolonged operation during the OFF vehicle 202 operating state. In an exemplary embodiment, the emergency alert message interruption system 204 can share control over operations of the digital audio recorder 216 to specifically record one or more broadcast radio channels from the audio system 224 upon the detection of one or more emergency alert messages that are provided by the EAS. In alternate embodiments, the digital audio recorder 216 is constantly recording various broadcast radio channels, and the emergency alert message interruption system 204 ensures that recordings of emergency alert messages are specifically tagged and identified. In an alternate embodiment, the emergency alert message interruption system 204 can be turned ON or OFF by the user in the vehicle 202 utilizing a specific switch or user interface within the vehicle 202.

The emergency alert message interruption system 204 can also control the digital audio recorder 216 to playback the recording of the emergency alert message(s) manually based on user or automatic actuation based on certain criteria related to the operating state of the vehicle 202, the operating state of the infotainment system 222, and additional factors, as discussed in detail below. The playback of the recording of the emergency alert message(s) takes place on one or more speakers 234 that are operably connected to both the digital audio recorder 216 and one or more components of the infotainment system 222.

The emergency alert message interruption system 204 (via the VCU) can share control over operations of the infotainment system 222 to interrupt operations of the system and to immediately broadcast one or more emergency alert messages upon the detection of the broadcast of the one or more emergency alert messages by the EAS on one or more radio station channels. The emergency alert message interruption system 204 can control the infotainment system 222 to stop or pause any current infotainment activity to ensure that the vehicle 202 occupants hear the emergency alert message(s) based on certain criteria related to the operating state of the vehicle 202, the operating state of the infotainment system 222, and/or other factors, as discussed in detail below.

The components and operations of the emergency alert message interruption system 204 will now be discussed in detail. In an exemplary embodiment, the emergency alert message interruption system 204 includes an emergency alert monitoring module 206 that is operably connected to the audio system 224. In one embodiment, the emergency alert monitoring module 206 utilizes the radio tuners of the audio system 224 to constantly scan radio frequencies on respective AM, FM, and/or satellite radio bands. The emergency alert monitoring module 206 instructs the audio system 224 to utilize the radio tuners to scan all frequencies continuously to provide frequency data to the radio receiver. The radio receiver provides the scanned frequency data to the emergency alert monitoring module 204.

In an alternate embodiment, the emergency alert message interruption system 204 includes a communication device (not shown) that can wirelessly communicate to an emergency alert monitoring server (not shown) that is located at a remote location. The emergency alert monitoring server can independently utilize external physical radio tuners (in various locations) or internet based radio tuners to scan and monitor radio frequencies and can provide the frequency data of scanned frequencies directly to the emergency alert monitoring module 206.

The emergency alert detection module 208 receives packets of data provided by the emergency alert monitoring module 206. The data packets include, but are not limited to, real time frequency data for all channels in all bands that are being monitored by the emergency alert monitoring module 206. The emergency alert detection module 208 identifies and detects the issuance of an audio indicator that includes specific types of alert tones that are associated with the broadcast of the emergency alert message(s) by the EAS.

The EAS utilizes specific types of tones that are embedded within a preamble of the emergency alert message that are broadcast on terrestrial or satellite radio. The emergency alert message preamble generally consists of a header burst that precedes a one second pause followed by an attention signal that is at least eight seconds in length. The emergency alert detection module 208 can detect the issuance of the preamble in one or more of the radio station frequencies that are being provided through the radio receiver of the audio system 224. In an exemplary embodiment, upon the detection of the issuance of the preamble, the emergency alert detection module 208 packets the emergency alert message(s) that are being provided by the audio system 224 and sends the packaged emergency alert message(s) to the recording module 210, the emergency alert prioritization module 212, and the emergency alert controller module 214.

In an exemplary embodiment, the recording module 210 is operably connected to the digital audio recorder 216 and communicates via computer communication with the processor 218. Upon the receipt of the packaged emergency alerts message(s) from the emergency alert detection module 208, the recording module 210 sends a command to the processor 218 of the digital audio recorder 216 to initialize the separate recording of the emergency alert message(s) on the storage device 220.

In one embodiment, the digital audio recorder 216 records the emergency alert message(s) from the start of the header burst until an ending tail signal that signifies the end of the emergency alert message. This recording can take place simultaneously with the recording of the full radio frequency broadcast (i.e., the entire content being broadcast on a particular radio station channel). However, the recording module 210 instructs the processor 218 to separately tag the portion of the recording(s) that contains the emergency alert message(s) to be stored separately and is separately accessible on the storage device 220.

The tagging of the emergency alert message(s) can include but are not limited to date and time stamping of the emergency broadcast massage(s). In one embodiment, the tagging of the emergency broadcast message(s) also includes prioritization of the message, as discussed in more detail below. The recording of the emergency broadcast message(s) can be associated with a visual indication that is provided on the audio system 224 or the digital audio recorder 216 to indicate to the vehicle 202 occupant(s) that the emergency alert message(s) has been recorded and is ready for playback.

In one embodiment, the user may actuate playback of the emergency broadcast message(s) directly from audio system 224 controls, infotainment system 222 controls, and the like. In an alternate embodiment, the recording of the emergency broadcast message(s) can be associated with the recording being displayed on the audio system 224 or infotainment system 222 user interface as a title that can include and be categorized by the associated tag (i.e., data, time, and/or prioritization tag). The user can select the emergency alert message(s) from a list of recorded alerts on the user interface to playback the corresponding emergency alert message(s).

In addition, to the user initiated playback, automatic playback can be initiated by the emergency alert message interruption system 204, as described in detail below. In an alternate embodiment, the digital audio recorder 216 automatically deletes the stored emergency alert message(s) off of the storage device 220 once the emergency alert message(s) has been heard and a certain time based pre-set threshold has been met. For example, the user can utilize the audio system 224 user interface to select a time based threshold (e.g., 30 days) that the emergency alert message(s) is to be stored until deletion. The vehicle 202 occupant(s) can additionally classify certain emergency alert messages as 'important' (e.g., starred) to indicate to the emergency alert message interruption system 204 that those emergency alert messages are not to be automatically deleted. In one embodiment, the alert can be forwarded to the vehicle 202 occupant's smartphone. The phone can be paired such that this information is known.

In an exemplary embodiment, the emergency alert prioritization module 212 receives the one or more packaged emergency alert messages from the emergency alert detection module 208 and evaluates the emergency alert message(s) in order to prioritize the emergency alert message(s). The emergency alert prioritization module 212 can decipher header event codes that are included within the header burst of the emergency alert message(s) provided by the EAS. These event codes signify alert message classifications (i.e., real alert, test alert), event descriptions (e.g., tornado, hurricane, flash flood, etc.), and alert types (e.g., messages, statements, watches, warnings, etc.).

In one embodiment, the emergency alert prioritization module 212 evaluates the header bursts of the one or more packaged emergency alert messages that are supplied by the emergency alert detection module 208 to determine if the emergency alert message(s) is a test alert message or a real alert message. The emergency alert prioritization module 212 can further evaluate header bursts of the emergency alert message(s) to determine the event descriptions to determine the type of event or emergency that is taking place. The emergency alert prioritization module 212 can categorize the types of emergency alerts based on the event description of the emergency alert. The emergency alert prioritization module 212 can also be programmed to include a predetermined default prioritization list that places certain categorizes on the description of the event/emergency and/or the type of alert that is being sent in the emergency alert message(s).

Referring now to FIG. 3, an illustrative example of a simple prioritization list that can be utilized by the emergency alert prioritization module 212 to categorize emergency alert messages. As shown, the emergency alert prioritization module 212 can categorize certain event descriptions in five categories (Very Low, Low, Medium, High, and Severe). Various events/emergencies can be categorized differently based on the event description (e.g., hurricane, high wind, tornado, etc.) and/or the event type (e.g., message, warning, watch, etc.). The emergency alert prioritization module 212 can also prioritize the emergency alert message(s) based on additional factors.

In one embodiment, a key prioritization factor includes the locality in which the vehicle 202 is traveling. The emergency alert prioritization module 212 can utilize the GPS navigation system 228 to determine the location in which the vehicle 202 is located with respect to the location of the emergency detailed within the emergency alert message(s). In one embodiment, the GPS navigation system 228 can include an emergency and/or weather detection warning feature that alerts users that the there is a emergency and/or weather issue in the area. The emergency alert prioritization module 212 can utilize this feature to further prioritize the emergency alert message(s) based on how near or far the vehicle 202 is located to the emergency.

The emergency alert prioritization module 212 can also take into account the city, state, and or region in which the vehicle 202 is traveling and known environment conditions in order to adaptively prioritize certain emergency alert descriptions and/or alert types. For example, if the vehicle 202 is traveling in region that is categorized as a high intensity earthquake prone area, the emergency alert prioritization module 212 can assign a higher priority to an earthquake warning emergency alert message as oppose to the situation when the vehicle 202 is traveling in a region where high intensity earthquakes do not occur.

The emergency alert prioritization module 212 can utilize various weighing factors to prioritize emergency alert messages. In alternate embodiments, the emergency alert message interruption system 204 can be programmed to categorize the emergency alert message(s) based on numerous descriptive and/or numeric prioritization categories. For example, the emergency alert message interruption system 204 can utilize a numeric point system to assign specific point values to emergency alert descriptions and alert types based on different cities, states, or regions. In alternate embodiments, priorities assigned by external government agencies (e.g., National Weather Service) can be utilized by the emergency alert prioritization module 212 in prioritizing various types of emergency alert messages.

In one embodiment, the emergency alert prioritization module 212 can send the prioritization data to the recording module 210. The recording module 210 can utilize the prioritization provided by the emergency alert prioritization module 212 to selectively instruct the digital audio recorder 216 to record certain emergency alert messages. For example, based on the prioritization data provided by the emergency alert prioritization module 212, the recording module 210 can utilize the prioritization data to only record real emergency alerts and disregard the recording of test alerts.

The emergency alert controller module 214 controls the selective real time broadcasting of emergency alert messages and/or playback of recorded emergency alert message(s) by the emergency alert message interruption system 204. As discussed above, the emergency alert detection module 208 sends the one or more packaged emergency alert messages to the emergency alert controller module 214. In an exemplary embodiment, upon receipt of the emergency alert message(s), the emergency alert controller module 214 determines the operating state of the vehicle 202 to determine if the vehicle 202 is in an OFF state, an accessory power (ACC) state, or an ON state. As described in detail below, in some embodiments, the emergency alert controller module 214 can send a signal based on operating state of the vehicle 202 and the operating state of the infotainment system 222 for the emergency alert message interruption system 204 to selectively interrupt infotainment system 222 activity to broadcast or playback the emergency alert message(s). The emergency alert controller module 214 can also send a signal based on the operating state of the vehicle 202 for the emergency alert message interruption system 204 to selectively playback recorded emergency alert message(s) from the digital audio recorder 216.

In one embodiment, the emergency alert controller module 212 can determine the operating state of the vehicle 202 based on the ignition switch state of the vehicle 202 (key or push button) by communicating with an engine control unit and/or electronic control unit (not shown) included within the vehicle 202. The engine control unit and/or the electronic control unit can determine if the ignition switch of the vehicle 202 is in an OFF position, an accessory ON (ACC) position, or an ignition ON position (ON) and can further provide this data to the emergency alert controller module 214. Based on this determination the emergency alert controller module 214 concludes if the vehicle 202 is being occupied and/or utilized. For example, if the ignition switch is in the ACC position, it is determined that even though the vehicle 202 engine is not turned ON (since the ignition switch is in the OFF position), there is a high likelihood that the vehicle 202 is being occupied by one or more occupants. Similarly, if the ignition switch is in the ON position, it is determined that there is a high likelihood that the vehicle 202 is being occupied at least by the driver of the vehicle 202.

The determination of the operating state of the vehicle 202 can additionally be evaluated to determine the power source (vehicle battery and/or independent power source) that can be utilized to power the vehicle safety alert system 200. The ACC or ON operating state of the vehicle 202 also can signify the ability for the vehicle 202 occupant(s) to utilize the infotainment system 222. In one embodiment, the emergency alert controller module 214 can independently or additionally utilize vehicle sensors to determine if there is any occupant(s) within the vehicle 202. For example, the emergency alert controller module 214 can communicate with the vehicle 202 electronic control unit to receive seatbelt and/or air bag sensor (not shown) information to determine if any occupants are seated within the vehicle 202.

Figure 4:
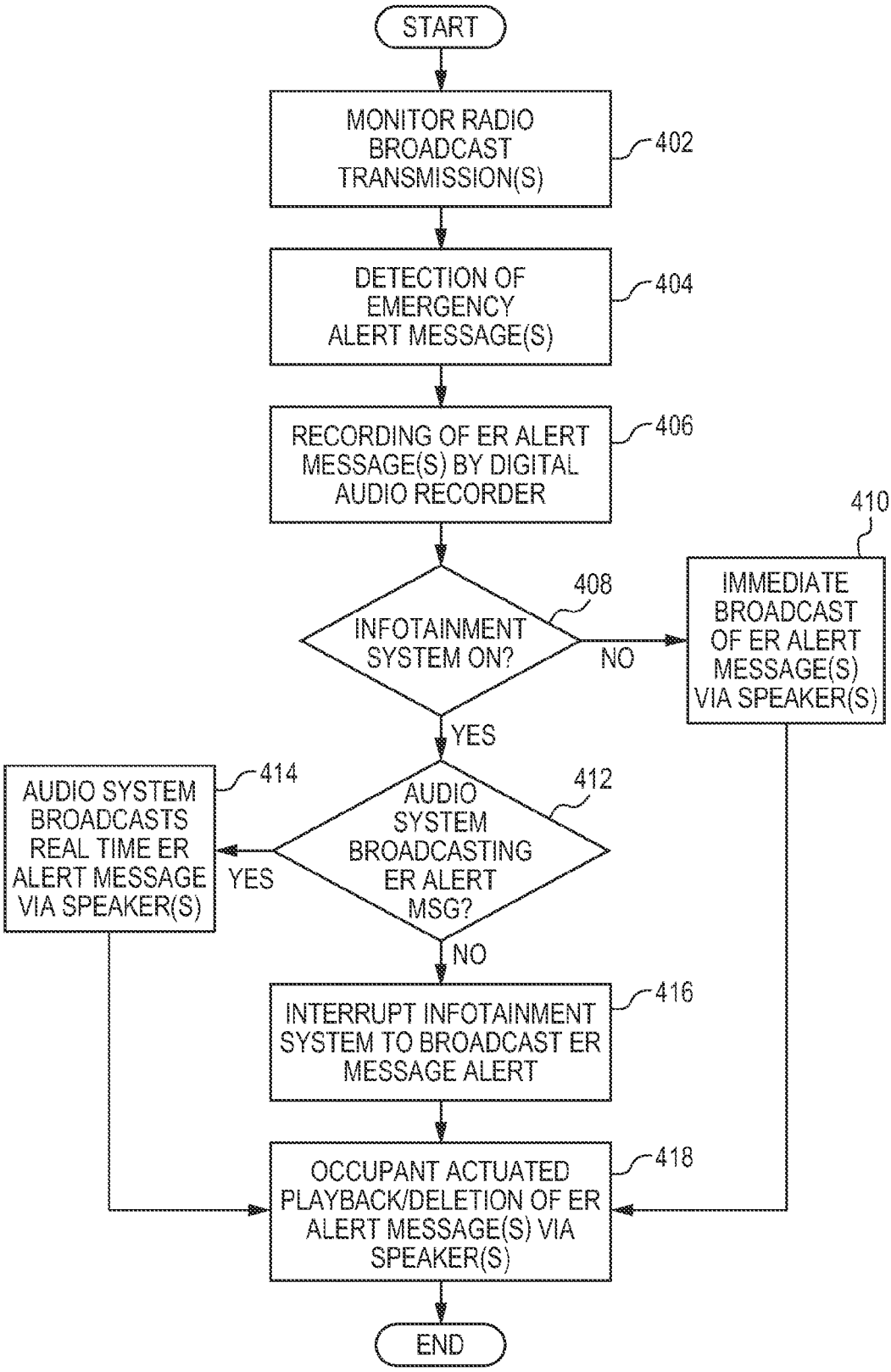
FIG. 4 is a process flow diagram of a method utilized by an exemplary embodiment of the emergency alert message interruption system from the operating environment of FIG. 2, wherein the vehicle is in an ACC or ON state, and/or any occupants are seated within the vehicle according to an embodiment of the disclosure.

Referring now to FIG. 4, a process flow diagram of a method utilized by an exemplary embodiment of the emergency alert message interruption system 204 from the operating environment of FIG. 2 is shown that occurs when the emergency alert controller module 214 determines that the vehicle 202 is in an ACC or ON state, and/or any occupants are seated within the vehicle 202. At block 402, the emergency alert monitoring module 206 utilizes the radio tuners of the audio system 224 to constantly scan radio frequencies on respective AM, FM, and/or satellite radio bands. At block 404, upon the detection of one or more emergency alert messages, the emergency alert detection module 208 sends the packaged emergency alert message(s) to the recording module 210. At block 406, the recording module 210 instructs the processor 218 of the digital audio recorder 216 to record the emergency alert messages(s), onto the storage device 220.

At block 408, the emergency alert controller module 214 determines if the infotainment system 222 (and/or its components 224-232) is in an ON or OFF state to conclude if the infotainment system 222 is utilized by any the vehicle 202 occupants. At block 410, if the infotainment system 222 is determined to be in an OFF state, the emergency alert controller module 214 sends an actuation signal and the emergency alert message interruption system 204 utilizes the speaker(s) 234 to immediately broadcast the emergency alert message(s) within the vehicle 202. For example, if the emergency alert controller module 214 determines that the occupants of the vehicle 202 are not utilizing the infotainment system 222, the emergency alert message interruption system 204 can utilize the speaker(s) 234 to provide a tone to signify that the emergency alert message(s) is being broadcast followed by the broadcast of the entire emergency alert message(s).

In the instance when more then one unique emergency alert message is simultaneously broadcast (on two or more radio station channels), the emergency alert message interruption system 204 can broadcast the multiple emergency alert messages in an order based on prioritization determined by the emergency alert prioritization module 212. After the emergency alert message(s) is broadcast, at optional block 418, the vehicle 202 occupant(s) can optionally playback and/or delete the recorded emergency alert message(s). For example, this functionality enables the vehicle 202 occupant(s) to rehear the message or play the message for an occupant who enters the vehicle 202 after the emergency alert message(s) has been broadcast (at block 408).

If the emergency alert controller module 214 determines that the infotainment system 222 is in an ON state (at block 408), the emergency alert controller module 212 further communicates with the infotainment system 222 to determine if the audio system 224 is already being utilized by the vehicle 202 occupant(s) to listen to the radio station channel that is broadcasting the emergency alert message(s) at block 412. At block 414, if it is determined that the vehicle 202 occupant(s) are already listening to the radio station channel that is broadcasting the emergency alert message(s), then the emergency alert message interruption system 204 does not interfere with the audio system and allows the audio system 224 to broadcast the real time emergency alert message via the speaker(s) 234.

In one embodiment, the emergency alert message interruption system 204 detects if the vehicle 202 occupant(s) changes the radio station channel or utilizes different audio system components, and/or other infotainment system components 224-232 during the real time broadcast of the emergency alert message (at block 412). For example, the vehicle 202 occupant(s) may intentionally change the radio station channel or utilize another function of the infotainment system 222 to avoid listening to the emergency alert message. In such an instance, the emergency alert message interruption system 204 can inform the vehicle 202 occupant(s) (i.e., by a visual indication) that the digital audio recorder 214 has recorded the emergency alert message(s) for the occupant(s) to optionally playback at a later point in time.

In an exemplary embodiment, when the emergency alert detection module 208 detects that more than one unique emergency alert message is being broadcast on more than one radio station channel at one time, the emergency alert message interruption system 204 follows the broadcast of the real time emergency alert message that is being broadcast on the radio station channel that is being tuned in (at block 414) with the playback of the other unique emergency alert message(s) (that was previously recorded at block 406) that are being simultaneously broadcast. For example, the vehicle 202 occupant(s) can be using the audio system 224 to listen to a radio station channel that starts to broadcast the emergency alert message related to a winter weather advisory, while another radio station channel may be simultaneously broadcasting an emergency alert message related to a high wind advisory. In such an instance, the audio system 224 can continue to broadcast the emergency alert message related to the winter weather advisory. Consequently, the current radio station channel being played can then be interrupted by the emergency alert message interruption system 204 to playback the (other) recorded unique emergency alert message related to the high wind advisory that was simultaneously broadcast.

In an alternate embodiment, when there are simultaneous broadcasts of unique emergency alert messages, the emergency alert message interruption system 204 can control the audio system 224 to broadcast the emergency alert message(s) that is being currently tuned in by the vehicle 202 occupants, unless the (other) unique emergency alert message that is being simultaneously broadcast is assigned a higher prioritization by the emergency alert prioritization module 212. In such a case, the emergency alert message interruption system 204 can control the audio system 224 to change the radio station channel to the radio station channel that is broadcasting the higher priority emergency alert message (at block 414) followed by the playback of the lower priority emergency alert message that was simultaneously recorded. In the instance that there is more then one additional unique emergency alert message being played back, the additional unique emergency alert messages can also be played back in an order based off of prioritization data provided by the emergency alert prioritization module 212.

Referring to block 416, in the instance that it is determined that the infotainment system is ON (at block 408), and the audio system 224 is not being utilized to tune in a radio station channel that is broadcasting an emergency alert message (at block 412), the emergency alert controller module 214 sends an actuation signal for the emergency alert message interruption system 204 to interrupt all activity of the infotainment system 222 and immediately broadcast the emergency alert message(s). In an exemplary embodiment, the emergency alert message interruption system 204 interrupts the infotainment system 222 by putting any infotainment activity into a pause state. Once the infotainment activity is in a pause state, the emergency alert message interruption system 204 broadcasts the emergency alert message(s) and subsequently un-pauses and restarts the infotainment system 222 activity from where it was paused. For example, if the video system 226 is being utilized by the vehicle 202 occupant(s) to playback recorded video (such as a DVD or digitally recorded video), upon receiving the signal from the emergency alert controller module 214, the emergency alert message interruption system 204 can pause the video activity in order to broadcast the emergency alert message(s) via the speaker(s) 234. Upon the completion of the broadcast of the emergency alert message(s), the emergency alert message interruption system 204 can then unpause and restart the video activity. This feature ensures that the speaker(s) 234 are dedicated to the reception of emergency broadcast alerts from the emergency alert message interruption system 204 while capturing the attention of the vehicle 202 occupant(s).

In an alternate embodiment, the emergency alert message interruption system 204 can selectivity decrease the volume of the any audio related infotainment activity or pause the infotainment activity based on data provided by the emergency alert prioritization module 212 in order to selectivity broadcast the emergency alert message(s). For example, if the telecommunication system 230 is being utilized by the vehicle 202 occupant(s) to make a telephone call, the emergency alert message interruption system 204 can selectively broadcast the lower priority emergency alert message(s) at a higher volume, while minimizing the volume of the telecommunication system 230 during the broadcast. This feature enables the vehicle 202 occupant(s) to continue the use of the telecommunication system 230 while the lower priority emergency alert message is being broadcast. Alternatively, the emergency alert message interruption system 204 can selectively pause the telecommunications system 230 activity to broadcast the higher priority emergency alert message(s) to ensure that the speaker(s) 234 are only utilized to broadcast the high priority emergency alert message.

As discussed above, there can be instances where the emergency alert controller module 214 determines if multiple unique emergency alert messages are being broadcast simultaneously on different radio station channels. In such an instance where more than one unique emergency alert message is being broadcast, the emergency alert controller module 214 can communicate with the emergency alert prioritization module 212 to determine the prioritization of each of the emergency alert messages. Based off of the prioritization provided by the emergency alert prioritization module 212, the emergency alert controller module 214 can prioritize the order of emergency alert messages that can be subsequently broadcast to the vehicle 202 occupants by the emergency alert message interruption system 204.

In other words, the emergency alert message interruption system 204 can first broadcast the emergency alert message with the highest prioritization, and can subsequently playback any other unique emergency alert message(s) that were broadcast simultaneously on other radio station channels in an order based on priority of each emergency alert message(s) with respect to another. For example, if the GPS navigation system 228 is being utilized by the vehicle 202 occupant(s) to receive turn by turn directions to a given destination, the emergency alert message interruption system 204 can pause the GPS navigation activity in order to broadcast the multiple emergency alert messages (via the speaker(s) 234) in an order based on the prioritization data provided from the emergency alert prioritization module 212.

As discussed above, at optional block 418, the vehicle 202 occupant(s) can selectively playback and/or delete the emergency alert message(s) based on the vehicle 202 occupant(s) discretion. A visual indication can be provided on the infotainment system 222, the audio system 224, and/or the digital audio recorder 216 to be shown to the vehicle 202 occupant(s) in order to indicate to the vehicle 202 occupant(s) that the emergency alert message(s) has been recorded and is ready for playback. Also, the infotainment system 222 and/or the audio system 224 user interface can provide an indication to the user that the emergency alert message(s) has been recorded and is ready for playback. The vehicle 202 occupant(s) can then selectively playback the emergency alert message(s) based on the vehicle 202 occupant(s) discretion.

In an alternate embodiment, the emergency alert message interruption system 204 can include a selective infotainment interruption mode that can include a button or input on the infotainment system 222 user interface, audio system 224 user interface, and/or another vehicle user interface for the vehicle 202 occupant(s) to selectively enable or disable the infotainment system 222 interruption by the emergency alert message interruption system 204 (that occurs at block 416). In one embodiment, in the instance when the vehicle 202 occupant(s) has selectively disabled the infotainment system 222 interruption by the emergency alert message interruption system 204, the emergency alert controller module 214 alerts the vehicle 202 occupant(s) that detected emergency alert message(s) are recorded and are ready for playback based on user actuation.

Figure 5:
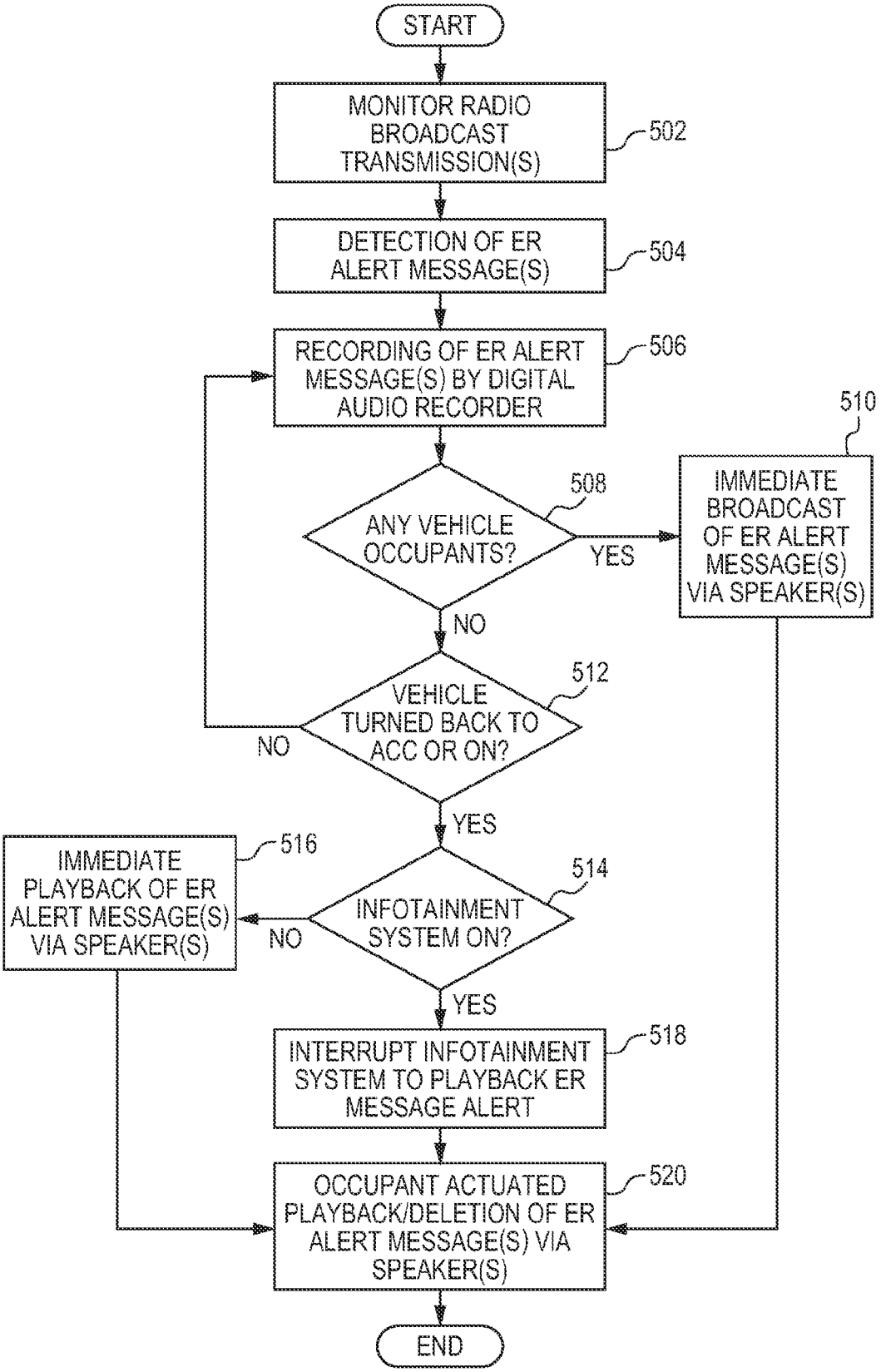
FIG. 5 is a process flow diagram of a method utilized by an exemplary embodiment of the emergency alert message interruption system from the operating environment of FIG. 2, wherein the vehicle is in an OFF state according to an embodiment of the disclosure.

Referring now to FIG. 5, a process flow diagram of a method utilized by an exemplary embodiment of the emergency alert message interruption system 204 from the operating environment of FIG. 2 is shown that occurs when the emergency alert controller module 212 determines that the vehicle 202 is in an OFF state. At block 502, the emergency alert monitoring module 206 utilizes the radio tuners of the audio system 224 to constantly scan radio frequencies on respective AM, FM, and/or satellite radio bands. At block 504, upon detection of one or more emergency alert messages, the emergency alert detection module 208 sends the packaged emergency alert message(s) to the recording module 210. At block 506, the recording module 210 instructs the processor 218 of the digital audio recorder 216 to record the emergency alert message(s), and the digital audio recorder 216 records and stores the emergency alert message(s) on the storage device 220.

At block 508, the emergency alert controller module 214 can utilize other vehicle sensors to determine if there are any occupants within the vehicle 202. For example, the emergency alert controller module 214 can utilize vehicle seatbelt and/or air bag sensors to determine if the vehicle 202 is being occupied. If the determination is made that the vehicle 202 is being occupied, at block 510, the emergency alert controller module 214 sends an actuation signal and the emergency alert message interruption system 204 utilizes the speaker(s) 234 within the vehicle 202 to immediately broadcast the emergency alert message(s) within the vehicle 202. As discussed above, the emergency alert message interruption system 204 can account for the situation when there is more then one unique emergency alert message broadcast by broadcasting the multiple emergency alert messages in an order based on the prioritization determined by the emergency alert prioritization module 212. After the emergency alert message(s) is broadcast, at optional block 520, the vehicle 202 occupant(s) can optionally playback and/or delete the recorded emergency alert message(s).

If it is determined that there are no occupants within the vehicle 202 (that is in an OFF state), the emergency alert controller module 214 continues to record emergency alert message(s) by the digital audio recorder 216 (at block 506) until it is determined that the vehicle 202 is turned back to the ACC or ON state, at block 510. Referring to block 514, upon determining that the vehicle 202 is turned back to the ACC or ON state (at block 512) the emergency alert controller module 214 further determines if the infotainment system is in an ON state.

In the event that the vehicle 202 is turned back to the ACC or ON state (at block 512), and the infotainment system 222 is determined to be in the OFF state (at block 514), then at block 516, the emergency alert controller module 214 sends an actuation signal and the emergency alert message interruption system 204 utilizes the speaker(s) 234 to immediately playback the emergency alert message(s) that were recorded (at block 506) while the vehicle 202 was turned OFF and/or no vehicle 202 occupants were detected within the vehicle 202 (at block 508). For example, upon reentering the vehicle 202, and turning the vehicle 202 key to change the ignition state from OFF to ACC or ON, the emergency alert message interruption system 204 can automatically and immediately initialize the digital audio recorder 216 to playback all emergency alert message(s) (by utilizing the speakers 234) that were broadcast by the radio station channel(s) and recorded by the digital audio recorder 216 while the vehicle 202 occupant(s) was away from the vehicle 202.

With respect to block 518, in the event that the vehicle 202 is turned back to the ACC or ON state (at block 512), and the infotainment system is in an ON state (at block 514), then the emergency alert controller module 214 sends an actuation signal for the emergency alert message interruption system 204 to interrupt the all activity of the infotainment system 222 and immediately playback the emergency alert message(s). As described above, the interruption of the infotainment activity can occur by putting the infotainment activity in a pause state and/or a lower volume state while the speaker(s) 234 are utilized by the emergency alert message interruption system 204. In the event there are multiple emergency broadcast messages that were recorded by the digital audio recorder 214, the emergency alert message interruption system 204 can playback the emergency alert messages in an order as deemed by the emergency alert prioritization module 212. At optional block 520, the vehicle 202 occupant(s) can selectively playback and/or delete the emergency alert message(s) based on the vehicle 202 occupant(s) discretion, as described in more detail above.

In some embodiments, the selective infotainment interruption mode can also be utilized to provide selective enabling of infotainment system 222 interruption by the emergency alert message interruption system 204 to broadcast or playback the emergency alert message(s) based on the emergency alert description and prioritization assigned to the emergency alert message(s) by the emergency alert prioritization module 212. For example, the emergency alert message interruption system 204 can be selectively controlled to only initiate the playback and/or the interruptions of real emergency alerts and to bypass the playback and/or the interruption of the infotainment system 222 with test emergency alert messages.

The emergency alert message interruption system 204 can also be selectivity controlled to only provide interruptions to broadcast or playback the emergency alert message(s) that are given a higher prioritization by the emergency alert prioritization module 212. For example, with reference to FIG. 3, the vehicle 202 occupant(s) can utilize the selective infotainment interruption mode to provide selective enabling of infotainment system 222 interruption by the emergency alert message interruption system 204 on emergency alert messages that are prioritized as 'High' or 'Severe' by the event alert prioritization module 212. The emergency alert message interruption system 204 can also provide an indication to the vehicle 202 occupant(s) of the recording of the lower prioritized emergency alert message(s), in order for the vehicle 202 occupant(s) to playback the lower prioritized emergency alert based on the occupant(s) discretion.

As discussed above, the location, city, state, and/or region in which the vehicle 202 is traveling can influence the prioritization of emergency alert messages by the emergency alert prioritization module 212. Therefore, with respect to the selective infotainment interruption mode, the emergency alert message interruption system 204 can take into account various factors that may further influence the prioritization assigned to the emergency alert message(s) by the emergency alert prioritization module 212 that influences the selective interruption for broadcast and/or playback. For example, when the vehicle 202 is traveling in the high intensity earthquake prone area, the emergency alert message interruption system 204 interrupts any infotainment activity to broadcast or playback the earthquake warning emergency alert message. Alternatively, when the vehicle 202 is traveling in an area where high intensity earthquakes do not occur, the emergency alert message interruption system 204 does not interrupt infotainment activity but simply informs the vehicle 202 occupant(s) that the emergency alert message(s) has been recorded by the digital audio recorder 214 and is ready for playback at the vehicle 202 occupant(s) discretion.

In one embodiment, the emergency alert message interruption system 204 can include a 'wake-up' mode that can be actuated by the vehicle 202 occupant(s) prior to exiting the vehicle 202. Upon the actuation of the 'wake-up' mode, the emergency alert controller module 214 can send an actuation signal for the emergency alert message interruption system 204 to immediately broadcast the emergency alert message(s) using the speaker(s) 234, even if the vehicle 202 does not contain any occupant(s) and is in the OFF state. Upon receipt of the emergency alert message(s) by the emergency alert detection module 208, the emergency alert message interruption system 204 with the wake-up mode initialized can either utilize internal speaker(s) 234 and/or external speaker(s) 234 at a full or increased volume to announce the emergency alert message(s) to those situated in the vicinity of the vehicle 202. For example, if the vehicle 202 occupant(s) exits the vehicle 202 and is situated in a location that is in proximity of the vehicle 202, he or she can still hear the emergency alert message(s) immediately upon its broadcast.

In an alternate embodiment, the 'wake-up' mode can be tied to other vehicle 202 technologies that determine if the former vehicle 202 occupant(s) that has exited the vehicle 202 is located in proximity of the vehicle 202. The emergency alert message interruption system 204 can communicate with the electronic control unit of the vehicle 202 to utilize vehicle key fob sensors to determine if the former vehicle 202 occupant(s) are in a closer proximity range of the vehicle 202. In an additional embodiment, the emergency alert message interruption system 204 can also utilize sensors and/or cameras located on the exterior of the vehicle 202 to determine if people are located around the vehicle 202 to determine if the emergency alert message interruption system 204 should utilize the 'wake-up mode' to immediately announce the emergency alert message(s).

In some embodiments in addition to utilizing the speaker(s) 234 of the vehicle 202, the emergency alert message interruption system 204 can utilize other components of the infotainment system 222 to also provide a visual and/or textual display of the emergency alert message(s). For example, the emergency alert message interruption system 204 can utilize the video system 224 or the GPS navigation system 228 to display the emergency alert message description, prioritization, and/or message text that can be shown in conjunction to the audio message being played on the speaker(s) 234.

Various embodiments of the emergency alert message interruption system 204 can be utilized to immediately interrupt and broadcast and/or playback emergency alert message(s). In one embodiment, the emergency alert message interruption system 204 can also be utilized to interrupt and broadcast and/or playback video based emergency alert messages through the video system 226. In an alternate embodiment, the emergency alert message interruption system 204 can utilize the communication system of the vehicle 202 to interrupt and broadcast and/or playback emergency alert messages through a (wired or wirelessly) connected portable electronic device. In an additional embodiment, the emergency alert message interruption system 204 can receive emergency alert message(s) from the (wired or wirelessly) connected portable electronic device and utilize the infotainment system 222 or the speaker(s) 234 to interrupt and broadcast and/or playback the emergency alert messages. Numerous components and technologies that have not been discussed herein can also be utilized to compute operations associated with the emergency alert message interruption system 204 to interrupt and announce, broadcast and/or playback the emergency alert message(s).

The embodiments discussed herein can also be described and implemented in the context of computer-readable storage medium storing computer-executable instructions. Computer-readable storage media includes computer storage media and communication media. For example, flash memory drives, digital versatile discs (DVDs), compact discs (CDs), floppy disks, and tape cassettes. Computer-readable storage media can include volatile and nonvolatile, removable and non-removable media implemented in any method or technology for storage of information such as computer readable instructions, data structures, modules or other data. Computer-readable storage media excludes non-transitory tangible media and propagated data signals.

Various implementations of the above-disclosed and other features and functions, or alternatives or varieties thereof, can be desirably combined into many other different systems or applications. Also, various presently unforeseen or unanticipated alternatives, modifications, variations or improvements therein can be subsequently made by those skilled in the art which are also intended to be encompassed by the following claims.

The invention claimed is:

1. A computer-implemented method for providing emergency broadcast interruption in a vehicle comprising:

receiving at least one radio broadcast transmission;

analyzing the at least one radio broadcast transmission to detect at least one emergency alert message on the at least one radio broadcast transmission;

assigning a priority to the at least one emergency alert message based on a type of the at least one emergency alert message, description of emergency detailed with the at least one emergency alert message, and proximity of the emergency detailed within the at least one emergency alert message with respect to the vehicle;

recording the at least one emergency alert message from the at least one radio broadcast transmission in which the at least one emergency alert message is detected; and controlling a component of the vehicle to play the at least one emergency alert message based on the priority assigned to the at least one emergency alert message, wherein controlling the component of the vehicle includes at least one of: enabling an infotainment player and playing the at least one emergency alert message within the vehicle when it is determined that the infotainment player is disabled and controlling the infotainment player to interrupt a currently playing infotainment stream that is taking place in the vehicle to play the at least one at least one emergency alert message when it is determined that the infotainment player is enabled and the currently playing infotainment stream is not playing the at least one emergency alert message.

2. The computer-implemented method of claim 1, wherein assigning the priority to the at least one emergency alert message includes assigning the priority to the at least one emergency alert message based on known environmental conditions within a region in which the vehicle is traveling.

3. The computer-implemented method of claim 1, wherein analyzing the at least one radio broadcast transmission includes identifying an audio indicator in the at least one radio broadcast transmission corresponding to an issuance of the at least one emergency alert message.

4. The computer-implemented method of claim 3, wherein analyzing the at least one radio broadcast transmission includes determining whether the type of the at least one emergency alert message includes a test emergency alert or a real emergency alert.

5. The computer-implemented method of claim 1, wherein controlling the component of the vehicle to play the at least one emergency alert message includes at least one: of playing the at least one radio broadcast transmission in which the at least one emergency alert message is detected and playing back the recording of the at least one emergency alert message.

6. The computer-implemented method of claim 5, wherein controlling the component of the vehicle to play the at least one emergency alert message includes at least one of: interrupting the currently playing infotainment stream that is taking place in the vehicle to broadcast the at least one emergency alert message and interrupting a currently playing infotainment steam that is taking place in the vehicle to playback the at least one recorded emergency alert message.

7. The computer-implemented method of claim 5, wherein controlling the component of the vehicle to play the at least one emergency alert message is based on at least one of: an operating state of the vehicle, and the priority assigned to the at least one emergency alert message.

8. The computer-implemented method of claim 7, wherein controlling the component of the vehicle to play the at least one emergency alert message includes playing back the at least one emergency alert message upon the operating state of the vehicle changing from an OFF ignition state to at least one of an ACC ignition state and an ON ignition state.

9. The computer-implemented method of claim 1, including providing power for recording the at least one emergency alert message from the at least one radio broadcast transmission in which the at least one emergency alert message is detected wherein the operating condition of the vehicle is in an OFF ignition state.

10. A computer-implemented method for providing emergency broadcast interruption in a vehicle comprising:

receiving at least one radio broadcast transmission;

analyzing the at least one radio broadcast transmission to detect at least one emergency alert message on the at least one radio broadcast transmission;

assigning a priority to the at least one emergency alert message based on a type of the at least one emergency alert message, description of emergency detailed with the at least one emergency alert message, and proximity of the emergency detailed within the at least one emergency alert message with respect to the vehicle;

recording the at least one emergency alert message from the at least one radio broadcast transmission in which the at least one emergency alert message is detected; and controlling a component of the vehicle to play the at least one emergency alert message based on the priority assigned to the at least one emergency alert message, wherein controlling the component of the vehicle includes at least one of: enabling an infotainment player and playing the at least one emergency alert message within the vehicle when it is determined that the infotainment player is disabled and controlling the infotainment player to interrupt a currently playing infotainment stream that is taking place in the vehicle to play the at least one at least one emergency alert message when it is determined that the infotainment player is enabled and the currently playing infotainment stream is not playing the at least one emergency alert message.

11. The system of claim 10, wherein assigning the priority to the at least one emergency alert message includes assigning the priority to the at least one emergency alert message based on known environmental conditions within a region in which the vehicle is traveling.

12. The system of claim 10, wherein analyzing the at least one radio broadcast transmission includes, determining whether the type of the at least one emergency alert message includes a test emergency alert or a real emergency alert.

13. The system of claim 10, wherein controlling the component of the vehicle to play the at least one emergency alert message includes at least one of: an audio system playing the at least one emergency alert message from the at least one radio broadcast transmission and the digital audio recorder playing back the recording of the at least one emergency alert message stored on the storage device.

14. The system of claim 13, wherein controlling the component of the vehicle to play the at least one emergency alert message includes at least one of: interrupting the currently playing infotainment stream that is taking place by an infotainment system of the vehicle to broadcast the at least one emergency alert message and interrupting the currently playing infotainment stream that is taking place by the infotainment system of the vehicle to playback the at least one recorded emergency alert message.

15. The system of claim 13, wherein controlling the component of the vehicle to play the at least one emergency alert message is based on at least one of: an ignition switch position of the vehicle, and the priority assigned to the at least one emergency alert message.

16. The system of claim 10, including providing power to record the at least one emergency alert message when the ignition switch of the vehicle is in an OFF position by at least one of: a battery of the vehicle and an independent power source.

17. A non-transitory computer readable storage medium, storing instructions that when executed by a computer, which includes a processor, performs a method, the method comprising:

monitoring at least one radio broadcast transmission;

analyzing the at least one radio broadcast transmission to detect at least one emergency alert message on the at least one radio broadcast transmission;

assigning a priority to the at least one emergency alert message based on a type of the at least one emergency alert message, description of emergency detailed with the at least one emergency alert message, and proximity of the emergency detailed within the at least one emergency alert message with respect to a vehicle;

recording the at least one emergency alert message from the at least one radio broadcast transmission in which the at least one emergency alert message is detected; and controlling a component of the vehicle to play the at least one emergency alert message based on the priority assigned to the at least one emergency alert message, wherein controlling the component of the vehicle includes at least one of: enabling an infotainment player and playing the at least one emergency alert message within the vehicle when it is determined that the infotainment player is disabled and controlling the infotainment player to interrupt a currently playing infotainment stream that is taking place in the vehicle to play the at least one at least one emergency alert message when it is determined that the infotainment player is enabled and the currently playing infotainment stream is not playing the at least one emergency alert message.

18. The non-transitory computer readable storage medium of claim 17, wherein assigning the priority to the at least one emergency alert message includes assigning the priority to the at least one emergency alert message based on known environmental conditions within a region in which the vehicle is traveling.

19. The non-transitory computer readable storage medium of claim 17, wherein controlling the component of the vehicle to play the at least one emergency alert message includes at least one of: playing the at least one radio broadcast transmission in which the at least one emergency alert message is detected and playing back the recording of the at least one emergency alert message.

20. The non-transitory computer readable storage medium of claim 18, wherein controlling the component of the vehicle to play the at least one emergency alert message includes interrupting the currently playing infotainment stream that is taking place in the vehicle based on at least one of: an operating state of the vehicle, and the priority assigned to the at least one emergency alert message.

* * * * *